US005577496A

United States Patent [19]

Blackwood et al.

[11] Patent Number: 5,577,496

[45] Date of Patent: Nov. 26, 1996

[54] RESPIRATORY PROTECTIVE APPARATUS

[75] Inventors: Thomas Blackwood, Biggar; Kenneth M. Govan, Milnagavie; Jacqueline Wilkie; Alaistair M. Deacon, both of Glasgow; Andrew D. Grant, Troon; Matthew T. Stickland, Stewarton, all of United Kingdom

[73] Assignee: Mine Safety Appliances Company, Pittsburgh, Pa.

[21] Appl. No.: 227,603

[22] Filed: Apr. 14, 1994

[30] Foreign Application Priority Data

Apr. 14, 1993 [GB] United Kingdom ..... 9307733

[51] Int. Cl.[6] ..... A62B 7/10

[52] U.S. Cl. ..... 128/201.25; 128/204.21; 128/204.23

[58] Field of Search ..... 128/201.25, 202.22, 128/204.18, 204.21, 204.23, 205.23

[56] References Cited

U.S. PATENT DOCUMENTS

| | | | |
|---|---|---|---|
| 4,331,141 | 5/1982 | Pokhis | 128/201.25 |
| 4,590,951 | 5/1986 | O'Connor | 128/201.25 |
| 5,009,225 | 4/1991 | Vrabel | 128/201.24 |
| 5,318,020 | 6/1994 | Schegerin | 128/204.21 |

FOREIGN PATENT DOCUMENTS

| | | |
|---|---|---|
| 0518538 | 12/1992 | European Pat. Off. . |
| 2032284 | 5/1980 | United Kingdom . |
| 2207307 | 1/1989 | United Kingdom . |

OTHER PUBLICATIONS

Patent Abstracts of Japan, vol. 13, No. 95, Pub. No. JP63275352; Pub. Date Nov. 14, 1988.

*Primary Examiner*—Aaron J. Lewis
*Attorney, Agent, or Firm*—James G. Uber

[57] ABSTRACT

The present invention relates to a respiratory protective apparatus utilizing a powered filtering device having a housing, with at least one inlet and an outlet, and a pump located between the inlet and the outlet for pumping air therebetween. The powered filtering device has a controller, preferably located at or near the outlet of the housing, for adjusting the air flow between the inlet and the outlet in response to a wearer's breathing pattern. Preferably, the controller does this by predicting the future breathing pattern of the wearer based on the past breathing pattern of the wearer. The powered filtering device also has a monitor to determine if the air flow through the respiratory protective apparatus falls below a set level and it does, alert the wearer to this condition.

17 Claims, 5 Drawing Sheets

RESPIRATORY PROTECTIVE APPARATUS

FIELD OF THE INVENTION

The present invention relates to respiratory protective apparatuses, and in particular to an improved powered filtering device for use in a respiratory protective apparatus.

BACKGROUND OF THE INVENTION

Respiratory protective apparatuses utilizing powered filtering devices or turbo filtering devices are known. In these devices air is delivered to a facepiece by a powered blower which is normally worn by the wearer using a body harness. The device may be connected to the facepiece by a breathing hose.

Powered filtering devices in some measure responsive to a wearer's demand are also known. For example, GB 2 032 284 discloses a respiratory breathing apparatus including a detector means for detecting exhalation by the wearer connected to a control means for at least reducing the flow of air through the filter means and flowing to the wearer during at least part of each exhale part of the breathing cycle of the wearer.

Such known devices, however, suffer from a number of problems and disadvantages. For example, in the device described in GB 2 032 284, the detector means is positioned at or near an inlet to a hood or face mask, remote from the control means. It must be connected to the control means by an electrical cable which must pass through the flexible breathing hose. The flexibility of the breathing hose, however, can cause the electrical cable to become weakened and liable to failure during use.

Another problem with known powered filtering devices is that they tend to be wasteful because they deliver air to a wearer when the wearer has no need of such air. This unnecessarily consumes filtration capacity and causes discomfort to the wearer.

Partially demand response devices, such as disclosed in GB 2 032 284, go some way to mitigating this problem. However, these devices still waste valuable electrical energy by overworking the device.

A further disadvantage of many known powered filtering devices is that they provide no measurement of air flow. As a result, a wearer is not provided with any warning that the air flow rate through the device has fallen below a minimum safe set level. Such a situation could easily occur due to filter clogging and the wearer needs to be advised of it in a timely manner.

It would be desirable, therefore, to have a powered filtering device which did not have these problems and disadvantages.

SUMMARY OF THE INVENTION

Generally, the present invention relates to a respiratory protective apparatus including a powered filtering device comprising a housing having at least one inlet and an outlet, a portable power supply and a pump located between the inlet and the outlet for pumping air therebetween. The respiratory protective apparatus also includes a facepiece, a filter, preferably provided at the inlet or the outlet, and a breathing hose, the first end of which is connected to the outlet and the second end of which is connected to the facepiece. The respiratory protective apparatus further comprises a controller connected to the pump which can adjust the air flow between the inlet and the outlet in response to a wearer's breathing pattern. Preferably, the controller is located proximate to the outlet. In one embodiment, the respiratory protective apparatus of the present invention operates by predicting the future breathing pattern of the wearer based on the past breathing pattern of the wearer. In another embodiment, it compares the breathing pattern to a set reference and adjusts the air flow to minimize the difference.

The facepiece may be of any kind including, by way of example only, a full face mask, half mask, quarter mask, mouthpiece assembly, helmet, hood, blouse or suit.

The filter may be connected to the inlet or the outlet and preferably comprises a filter canister having a housing containing a filter media. Alternatively, the filter may be contained within the housing of the powered filtering device. More than one filter can be used as is clear from the description of the preferred embodiments.

Preferably, the present invention relates to a powered filtering device comprising a housing having at least one inlet and an outlet, a portable power supply, a pump being provided between the inlet and the outlet for pumping air therebetween and a controller, preferably being provided at or near the outlet of the housing, for adjusting the speed of the pump and thereby increasing or decreasing the air flow between the inlet and the outlet in response to a wearer's breathing pattern.

The controller preferably comprises a pressure sensor connected to a microcontroller. In one embodiment, an electrical signal generated by the pressure sensor is periodically compared with a set reference level stored within the microcontroller to generate an error signal which is used to adjust the operation of the pump so as to seek to minimize the error signal. In another embodiment, the microcontroller has the capability of storing data regarding a wearer's past breathing pattern and using this information to predict the wearer's likely demand and thereby adjust the speed of the pump accordingly. The microcontroller uses a transfer function algorithm to predict the wearer's demand.

The pressure sensor is preferably located at or near the outlet of the powered filtering device. It should, however, be appreciated that the sensor may be suitably located within the breathing hose or within the facepiece. The microcontroller is preferably provided within the housing.

The respiratory protective apparatus of the present invention further comprises a monitor which determines if the air flow through the respiratory protective apparatus falls below a first set level, and increases the speed of the pump so as to seek to regain a preset air flow level above the first set level should the air flow fall below the first set level.

The monitor may further detect if the air flow through the respiratory protective apparatus falls below a second set level which second set level is below the first set level. The respiratory protective apparatus further comprises an alarm which is activated to warn the wearer if the air flow falls below the second set level.

Preferably, the monitor comprises a detector located in an air flow passage between the inlet and the outlet and a microcontroller. Preferably, the detector is a thermistor which is connected to the microcontroller. The microcontroller can be the same one as in the controller. The microcontroller stores the first and second set levels and compares the electrical signal from the detector to the first and second set levels and causes the pump to increase or decrease in speed so as to seek to regain a preset air flow level above the first set level if the detected signal is less than the first set level or the alarm to be activated if the detected signal is less than the second set level. Preferably the detector is located at or near the outlet.

Other details, objects and advantages of the present invention will become apparent as the following description of the presently preferred embodiments and presently preferred methods of practicing the invention proceed.

BRIEF DESCRIPTION OF THE DRAWINGS

Preferred embodiments of the present invention will now be described, by way of example only, with reference to the accompanying drawings, in which:

FIG. 3(*b*) is a partial end view of the secondary air flow passage of FIG. 3(*a*) along direction 'A';

DESCRIPTION OF THE PREFERRED EMBODIMENTS

Figure 1:
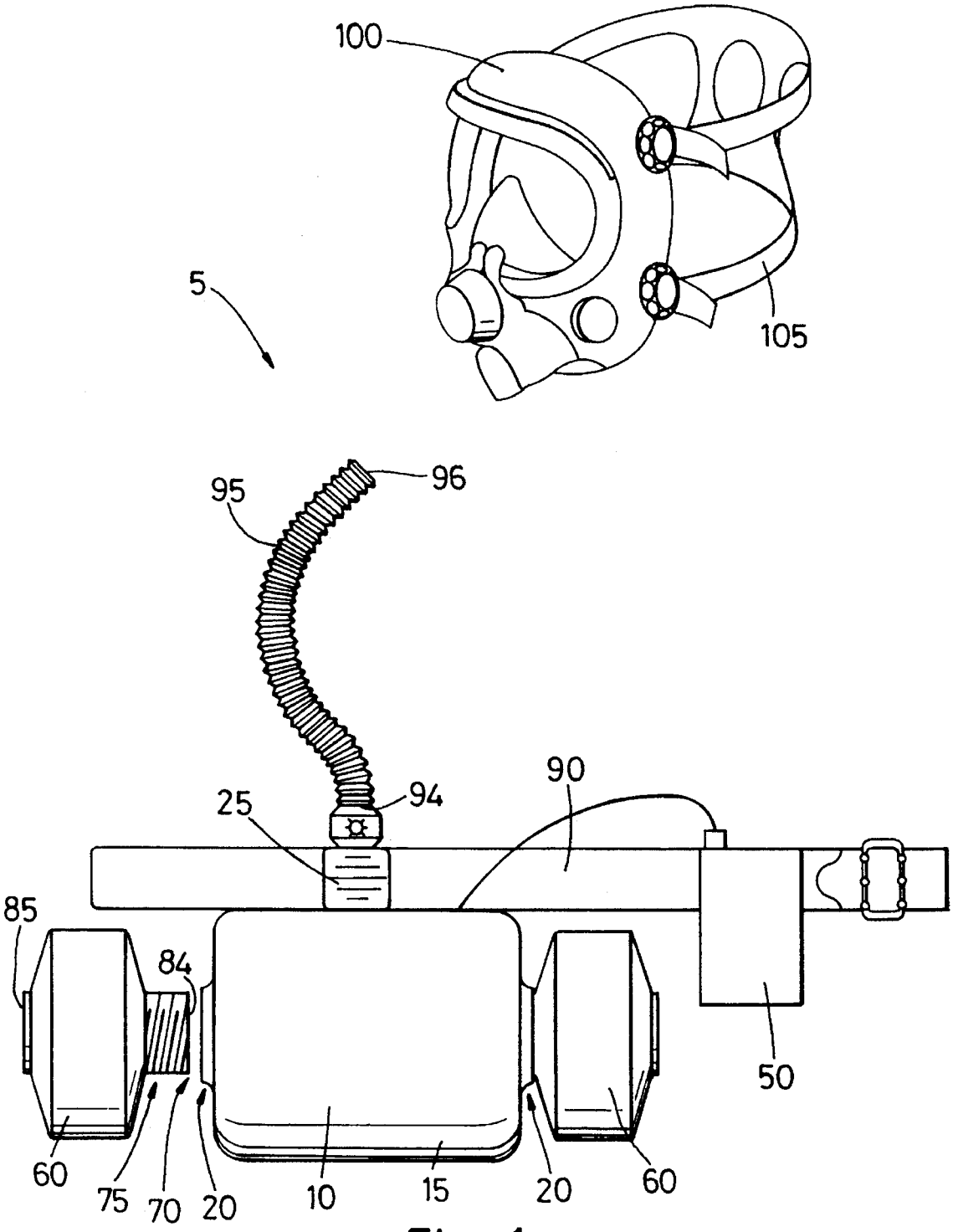
FIG. 1 is a schematic view of a respiratory protective apparatus according to one embodiment of the present invention.

Referring to the drawings, there is illustrated a preferred embodiment of a respiratory protective apparatus according to the present invention, generally designated 5, including a powered filtering device 10 having a housing 15 with (in this embodiment) two inlets 20 and an outlet 25. The main housing 15 is preferably made from a molded plastic.

Figure 2:
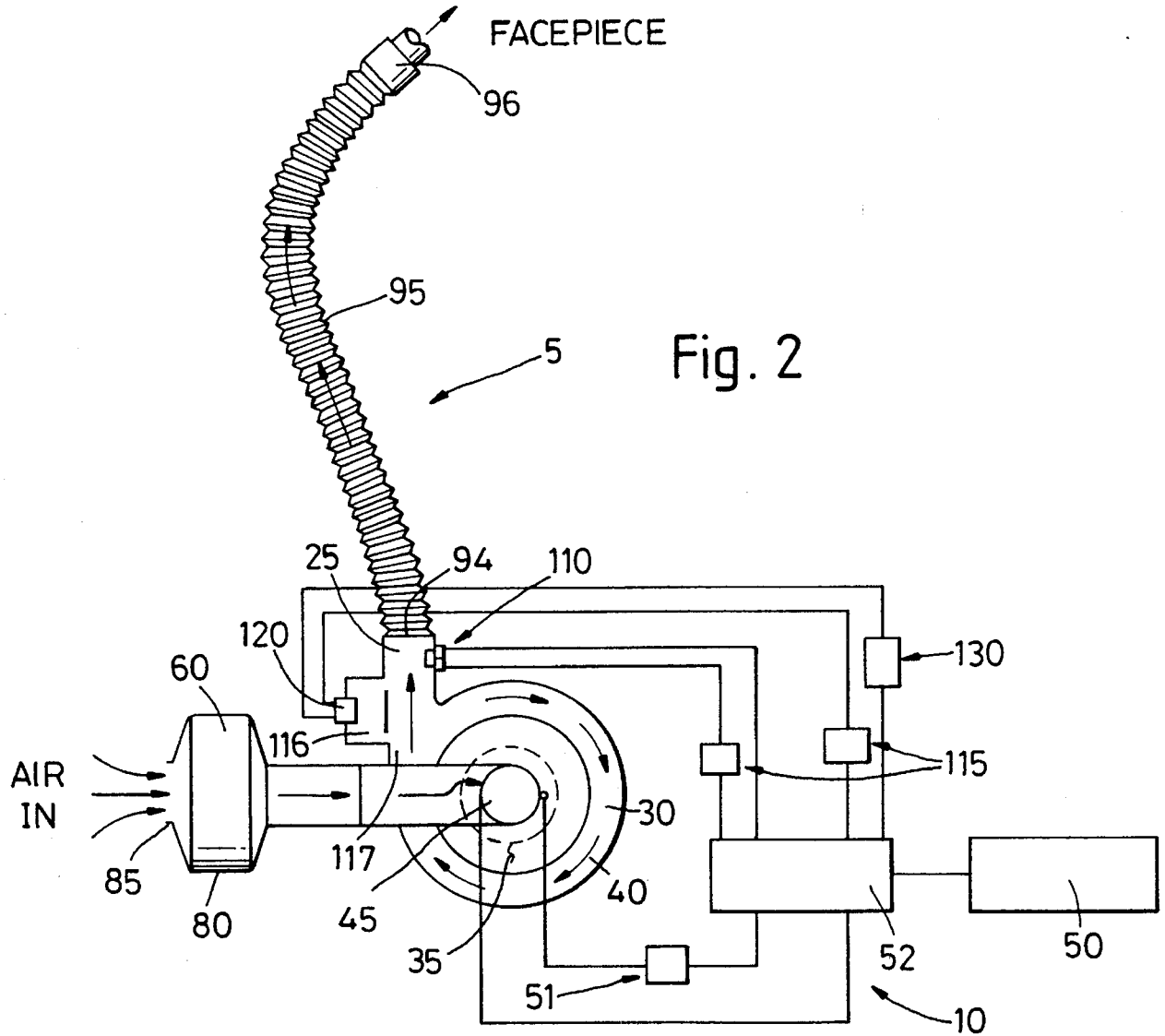
FIG. 2 is a more detailed schematic view of the respiratory protective apparatus of FIG. 1.

Between the inlets 20 and the outlet 25 there is provided a chamber 30. In the chamber 30 there is provided a pump preferably in the form of an impeller (blower) 35. The impeller 35 is suitably mounted within the chamber 30 so as to be substantially coaxially mounted within the chamber 30 and rotatable therein. As can be seen best from FIG. 2, the diameter of the impeller 35 is smaller than that of the chamber 30; thus an air flow passage 40 is defined between the outer circumference of the impeller 35 and the innermost cylindrical surface of the chamber 30.

The impeller 35 is driven, when in use, by a DC motor 45 which is powered from a battery-pack 50. Provided between the DC motor 45 and the battery pack 50 is an electronic switch 51 and microcontroller 52. The purpose and functioning of the microcontroller 52 will be described in more detail hereinafter.

In this embodiment, filter canisters 60 are connect-able to the main housing 15 at each of the inlets 20. Each of the filter canisters 60 may be attached to an inlet 20 by means of co-acting threaded portions 75,70 provided on the housing of the filter canister 60 at or near an outlet 84 thereof and an inner surface of the inlet 20.

Each filter canister 60 is suitably sized and shaped so as to retain a filter media (not shown) therein. Each filter canister 60 further has an inlet aperture 85. It can, therefore, be seen that an air path is formed via inlet apertures 85 through each filter canister 60 via the filter media (not shown) to outlet 84 and thence through inlet 20, impeller 35, and chamber 40 to outlet 25.

The main housing 15 and the battery pack 50 may each have a connector by which they can be retained on a body harness—which in this embodiment is in the form of a belt 90.

The outlet 25 is connected to a first end 94 of a flexible breathing (air supply) hose 95. The breathing hose 95 may be corrugated. A second end 96 of the breathing hose 95 is connected to an inlet of a facepiece—which in this embodiment is a full face mask 100 having a head harness 105.

At or near the outlet 25 there preferably is provided a controller for increasing or decreasing the speed of the impeller 35 in response to a wearer's inhalation requirements. Preferably, the controller comprises a pressure sensor 100 which is connected to the microcontroller 52 via a first signal conditioner 115. The signal conditioner 115 includes an amplifying function.

A mode selector switch (not shown) may be provided on the housing 15 to allow a wearer to switch the respiratory protective apparatus between various modes of operation.

First Mode of Operation

In use in a first mode of operation, an electrical signal generated by the pressure sensor 110 is periodically (e.g. every 0.04 seconds) compared to a set reference level, the value of which is preprogrammed into the microcontroller 52, and a corresponding error signal created. The microcontroller 52 can then employ the error signal to adjust the operation of the DC motor 45 controlling the impeller 35 and thereby attempt to minimize the error signal. The apparatus 5, therefore, provides a breath responsive air supply. This is evidenced by FIGS. 4 and 5 which show, for differing methods of operation of the microcontroller 52: (a) a typical breathing cycle of a wearer; (b) pressure at the outlet 25, sensed by the pressure sensor 110; and (c) power consumed by the DC motor 45 when under the control of the microcontroller 52.

As can be seen from FIG. 4, on inhalation the pressure at the sensor 110 drops, eventually dropping below the set point level. The microcontroller 52 seeks to increase the pressure at the sensor 110 back to the set point level by increasing the power to the motor 45, and thereby the motor speed. Once the set point has been regained, the power to the motor 45 is decreased to its original level.

A number of different methods of operation of the microcontroller 52 have been envisaged. Some of these will be described in more detail hereinbelow.

Basic Integral Method

Figure 4:
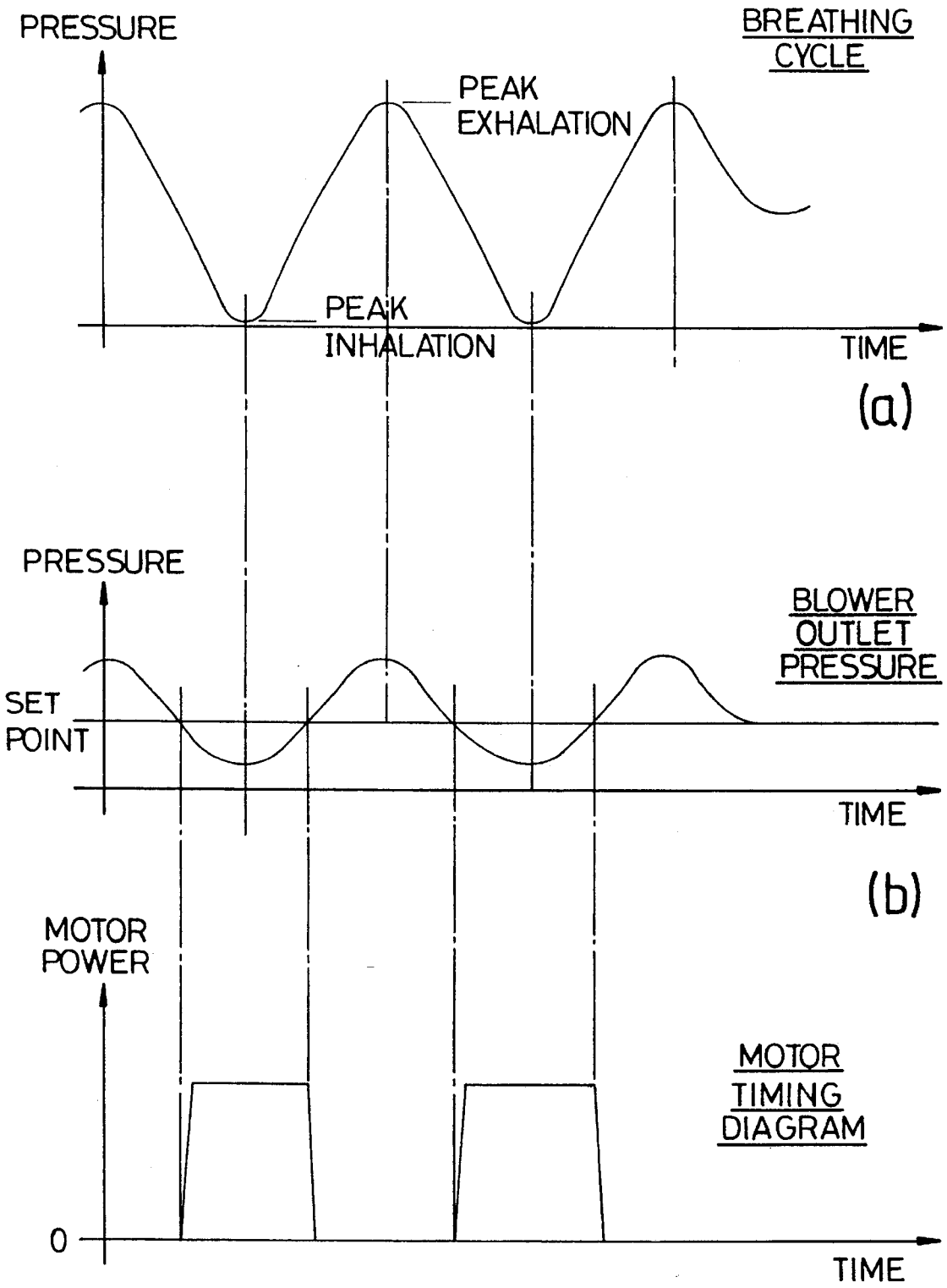
FIG. 4 is a series of typical timing diagrams relating to the respiratory protection device of FIG. 1 operating in a first mode by the so-called Integral or Integral Plus Bang methods.

Referring to FIG. 4, a first method of operation which has been devised—the so-called basic Integral Controller—which calculates the error signal between the blower outlet pressure and the setpoint once every time period, such as every 0.04 seconds. The error signal is then added to or subtracted from a variable Motor Speed and the motor speed updated accordingly. The calculation given below is, therefore, performed once during every time period:

$$\text{Motor Speed}=\text{Motor Speed}=(\text{Setpoint}-\text{Blower Outlet Pressure})$$

All these variables may be 8 or 16 bit integers. When Motor Speed=0, the motor is fully on. When Motor Speed=255, the motor is fully off. When the blower outlet pressure is below the setpoint, the Motor Speed should be adjusted as given in the formula above. It has been found employing this method that the microcontroller 52 responds breath by breath to the wearer's breathing pattern.

The calculation described above can be enhanced by adding a gain to the error term, as given in the formula below:

Motor Speed=Motor Speed±Integral Gain * A where A=Setpoint−Blower Outlet Pressure

Integral Plus Bang Method

A drawback with the basic Integral method of operation of the microcontroller 52 is that the motor speed only ramps up to full speed during the latter portion of an inhalation cycle. This means that during the latter portion of inhalation the motor 45 is still accelerating and therefore not supplying as much air as could be possible. To overcome this, a number of other control algorithms for the microcontroller 52 may be used. All of these algorithms attempt to supply more air during the latter part of a wearer's inhalation.

Previously, when using the blower with no microcontroller 52, it has been observed that with a reasonable level of breathing, the pressure inside the mask 100 still went negative. This implies that there is no reason just to ramp up the motor speed during the start of inhalation, but instead the motor unit should be turned fully on. This is the reasoning behind the 'Integral Plus Bang' method of operation of the microcontroller 52. During rest and exhalation, the basic Integral controller described above would regulate the motor speed to maintain a constant pressure at the outlet 25.

To detect the start of an inhalation, the blower outlet 25 pressure is compared to the setpoint. If the outlet pressure falls below the threshold level, the microcontroller 52 would turn the motor 45 fully on as described below:

If (Setpoint−Blower Outlet Pressure)<Threshold then Motor Speed=Motor Speed±Integral Gain * A where A=Setpoint—Blower Outlet Pressure Else turn motor full on.

This gives more of a boost to the impeller 35 at the start of an inhalation. With this method, there is of course the drawback of increased power consumption.

90° Phase Advance Method

Figure 5:
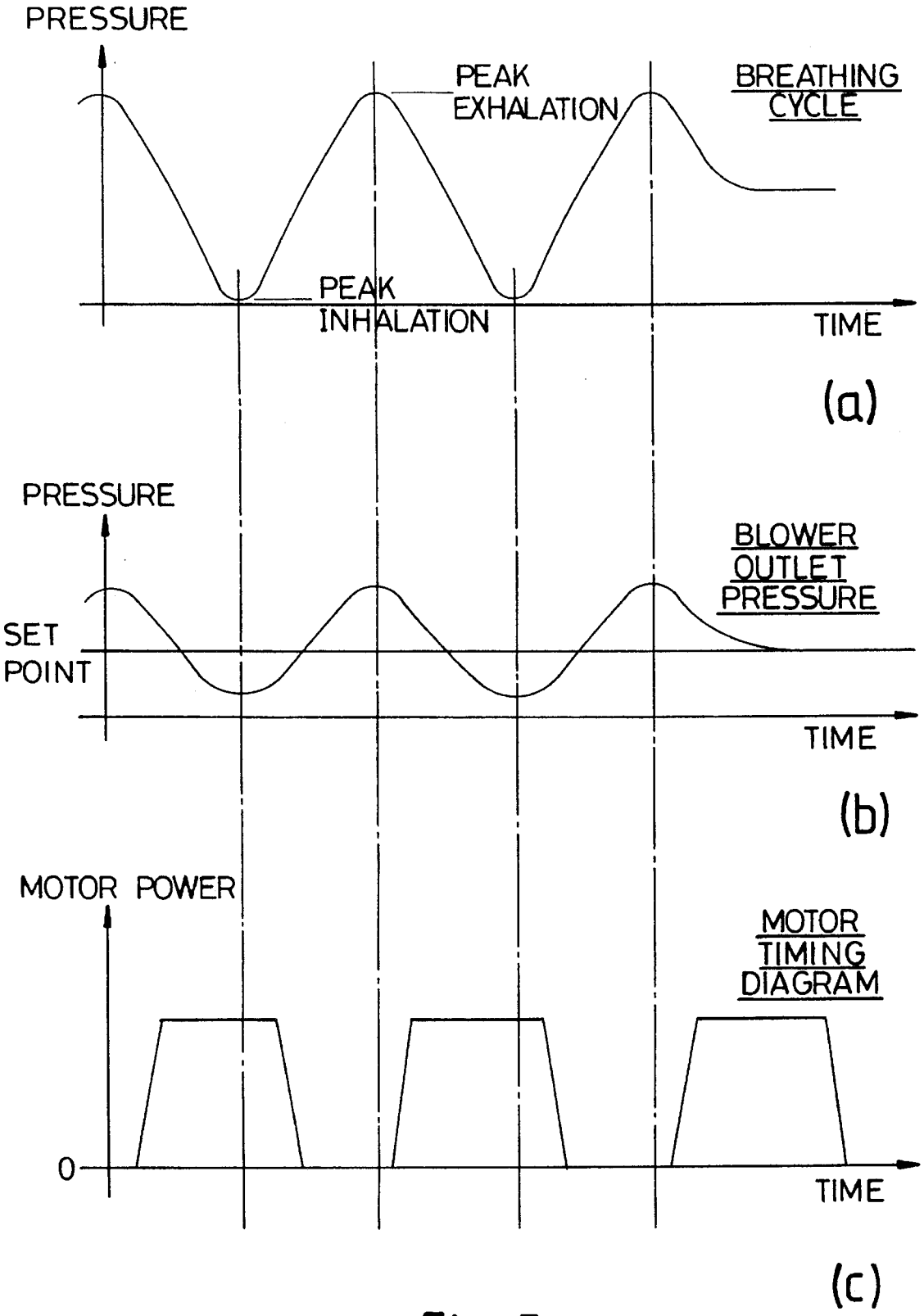
FIG. 5 is a series of typical timing diagrams relating to the respiratory protective apparatus of FIG. 1 operating in the first mode by the so-called 90° Phase Advance method.

Referring to FIG. 5, a further method—which may be called the "90° Phase Advance Controller"—uses the fact that the wearer's breathing pattern, and therefore the error signal, is periodic with a frequency range of typically 0.3 to 6 rad/sec. By leading the phase of the error signal, the speed of the motor 45 can be ramped up in anticipation of the start of a breath. A phase lead controller has been calculated for a 90° phase lead over this frequency range and centered on 2 rad/sec. This gave the following transfer function (G) of time (s):

$$G(s)=\frac{(1+1.37s)^2}{(1+0.18s)^2}$$

Using a sample frequency of 25 Hz, the phase lead controller can be converted using a bilinear conversion to the following digital filter:

$$Y_k=1.63Y_{k-1}-0.64Y_{k-2}+0.833e_k-1.619e_{k-1}+0.786e_{k-2}$$

where, $Y_k$=digital filter output and k=a constant. The above filter includes a gain compensation to reduce the gain at high frequency.

The Phase Advance Controller can be coded using a fixed point arithmetic to give accuracy to the coefficients of the equation. Full IEEE floating point algorithms could alternatively be used.

Implementation problems have been found in the 90° phase lead controller. A simpler 45° phase lead controller can therefore be designed. This gave the following transfer function:

$$G(s)=\frac{(1+1.37s)}{(1+0.18s)}$$

Again as in the basic Integral controller, the motor power would be ramped up during inhalation, but not rapidly enough to satisfy the demand. The 45° phase lead controller can, therefore, be cascaded to produce a 90° lead controller.

Second Mode of Operation

Referring again to FIG. 2, the device 5 further comprises a monitor for detecting if air flow through the device 5 falls below a first set level and for increasing the impeller 35 so as to seek to regain a preset air flow level above the first set level should the air flow fall below the first set level. The monitor may also detect if air flow through the respiratory protective apparatus falls below a second set level which second set level is below the first set level. Preferably the respiratory protective apparatus further comprises an alarm which is activated to warn the wearer if the air flow falls below the second set level. Air flow reduction could be due, for example, to either filter clogging during use or replacement of a filter with a filter of greater resistance to air flow.

In use in the second mode of operation, the apparatus 5 does not provide a breath responsive air supply. Rather, a signal detected by a detector, preferably the thermistor 120, is compared to both of the set levels. If the detection signal is less than the first set level, then the microcontroller 52 acts to increase the speed of the impeller 35 so as to seek to increase the air flow to the preset air flow level.

During usage, the filter may become clogged or blocked. This may prevent the air flow from being increased to the preset air flow level. In this event the detected signal may fall below the second set level. In such case the alarm 130 will be activated thereby warning the wearer of low air flow.

The thermistor 120 (in this embodiment) is a small bead thermistor, such as that produced by Fenwal® Electronics Inc. under their code number 111 202 CAK R01. Alternatively, a so-called Betacurve small precision matched NTC, R–T curve matched thermistor could be used.

Figure 3B:
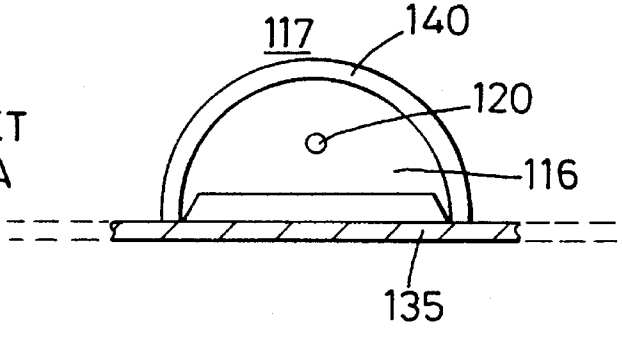
FIG. 3(*a*) is a partial cross-sectional side view of a secondary air flow passage provided in the respiratory protective apparatus of FIG. 1.
Figure 3A:
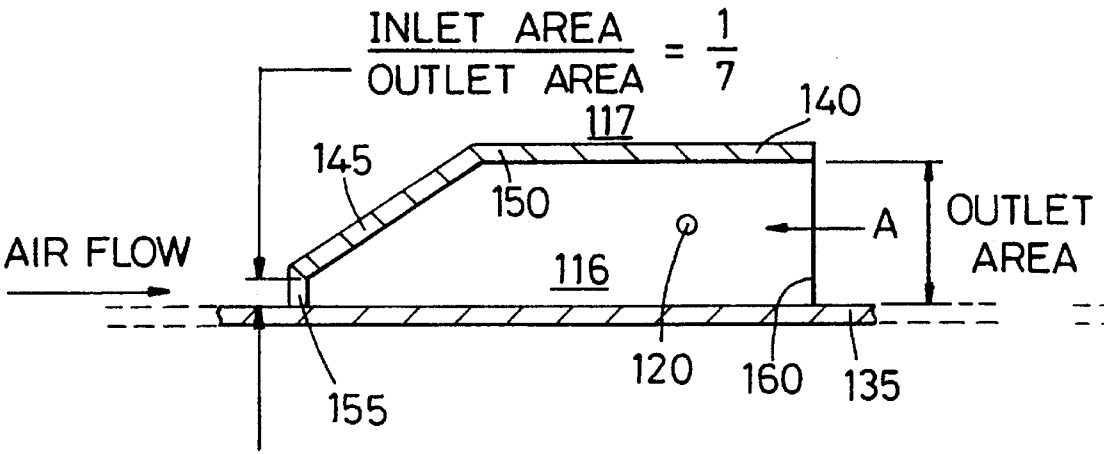

The secondary air flow passage 116 may be formed in a number of different ways. Referring to FIGS. 3(*a*) and 3(*b*), there is illustrated one way of forming the secondary passage 116 on an inner side of a wall 135 of the primary air flow passage 117 employing a wall 140. The wall 140 is formed from integral semi-frustoconical and semi-cylindrical portions 145 and 150, and provides an inlet 155 and an outlet 160. The thermistor 120 is suitably retained within the secondary passage 116.

In this embodiment, the inlet 155 to outlet 160 size ratio is 1 to 7. This, in combination with the shape of the wall 140, causes air flow therethrough to decelerate and become less turbulent thereby effecting a smoother signal from the thermistor 120.

Finally, it should be appreciated that the embodiments of the invention hereinbefore described with particularity are given by way of example only, and that the invention may be otherwise embodied within the scope of the following claims.

What is claimed:

1. A respiratory protective apparatus having a facepiece, a breathing hose, a powered filtering device, and a filter connected together to form an air flow path, the powered filtering device comprising a housing having at least one inlet and an outlet, a portable power supply, a variable speed pump located between the inlet and the outlet for pumping air therebetween, and a controller connected to the pump including means for storing data regarding a wearer's past breathing pattern, predicting a wearer's likely demand; the controller further including means for controlling the speed of the pump responsive to data which includes a wearer's past breathing pattern.

2. The respiratory protective apparatus as described in claim 1, wherein the facepiece is selected from the group consisting of a full mask, half mask, quarter mask, mouthpiece assembly, helmet, hood, blouse or suit.

3. The respiratory protective apparatus described in claim 1, wherein the controller is located proximate to the outlet.

4. A respiratory protective apparatus as described in claim 1, wherein the filter is contained within the housing of the powered filtering device and connected between the inlet and the outlet.

5. The respiratory protective apparatus as described in claim 1, wherein the controller comprises a pressure sensor connected to a microcontroller, the microcontroller predicting the wearer's likely demand using a transfer function algorithm.

6. The powered filtering device as described in claim 5, wherein the microcontroller uses the following transfer function G(s)

$$G(s) = \frac{(1 + 1.37s)}{(1 + 0.18s)}$$

to predict the wearer's likely demand.

7. The respiratory protective apparatus as described in claim 5 wherein the controller applies a 90° phase advance to the data which includes a wearer's past breathing pattern to predict the wearer's likely demand.

8. The respiratory protective apparatus as described in claim 5 wherein the controller applies a 45° phase advance to the data which includes a wearer's past breathing pattern to predict the wearer's likely demand.

9. A respiratory protective apparatus as described claim 1, further comprising a monitor for detecting if air flow through the respiratory protective apparatus falls below a set level, and an alarm which is activated to warn the wearer if the air flow falls below the set level.

10. A powered filtering device comprising a housing having at least one inlet and an outlet, a portable power supply, a variable speed pump being provided between the inlet and the outlet for pumping air therebetween, and a controller connected to the pump including means for storing data regarding a wearer's past breathing pattern, predicting a wearer's likely demand; the controller further including means for controlling the speed of the pump responsive to data which includes a wearer's past breathing pattern.

11. The powered filtering device as described in claim 10, wherein the controller is located near the outlet.

12. The powered filtering device as described in claim 10, further comprising a filter located within the housing and connected between the inlet and the outlet.

13. The powered filtering device as described in claim 10, wherein the controller comprises a pressure sensor connected to a microcontroller which generates a signal which is used to adjust the air flow between the inlet and the outlet.

14. The powered filtering device as described in claim 13, wherein the microcontroller predicts the wearer's likely breathing demand using a transfer function algorithm.

15. The powered filtering device as described in claim 14, wherein the microcontroller uses the following transfer function G(s)

$$G(s) = \frac{(1 + 1.37s)}{(1 + 0.18s)}$$

to predict the wearer's likely breathing demand.

16. The respiratory protective apparatus as described in claim 14 wherein the controller applies a 90° phase advance to the data which includes a wearer's past breathing pattern to predict the wearer's likely demand.

17. The respiratory protective apparatus as described in claim 14 wherein the controller applies a 45° phase advance to the data which includes a wearer's past breathing pattern to predict the wearer's likely demand.

* * * * *